US011971035B2

(12) United States Patent
Montejo

(10) Patent No.: US 11,971,035 B2
(45) Date of Patent: Apr. 30, 2024

(54) VARIABLE COMPRESSOR HOUSING

(71) Applicant: Johnson Controls Technology Company, Auburn Hills, MI (US)

(72) Inventor: Franklin Aaron Montejo, York, PA (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 382 days.

(21) Appl. No.: 16/762,094

(22) PCT Filed: Nov. 6, 2018

(86) PCT No.: PCT/US2018/059456

§ 371 (c)(1),
(2) Date: May 6, 2020

(87) PCT Pub. No.: WO2019/094386

PCT Pub. Date: May 16, 2019

(65) Prior Publication Data

US 2021/0372406 A1 Dec. 2, 2021

Related U.S. Application Data

(60) Provisional application No. 62/583,372, filed on Nov. 8, 2017.

(51) Int. Cl.
*F04C 28/14* (2006.01)
*F04C 18/16* (2006.01)
(Continued)

(52) U.S. Cl.
CPC ..... *F04C 28/08* (2013.01); *F04C 18/16* (2013.01); *F04C 28/14* (2013.01); *F04C 29/12* (2013.01);
(Continued)

(58) Field of Classification Search
CPC ..... F04C 18/16; F04C 28/04; F04C 28/14; F04C 29/12; F04C 2210/228; F04C 2250/102; F04C 2270/185
See application file for complete search history.

(56) References Cited

U.S. PATENT DOCUMENTS 4,610,612 A * 9/1986 Kocher ..... F04C 28/125 417/310
2012/0282129 A1 11/2012 Nemit, Jr.
(Continued)

FOREIGN PATENT DOCUMENTS

BE 488315 A 4/1949
CN 201344131 Y 11/2009
(Continued)

OTHER PUBLICATIONS

International Search Report and Written Opinion for PCT Application No. PCT/US2018/059456 dated Feb. 15, 2019, 13 pgs.
Chinese Office Action for CN Application No. 201880070518.9, dated May 20, 2021, 9 pgs.
1 Taiwan Office Action and Search Report for TW Application No. 107139536, dated May 4, 2022, 12 pgs.

*Primary Examiner* — Connor J Tremarche
(74) *Attorney, Agent, or Firm* — Fletcher Yoder, PC

(57) ABSTRACT

The present disclosure relates to a compressor having a first rotor and a second rotor disposed within a housing, where the first rotor is configured to rotate about a first axis of the housing and the second rotor is configured to rotate about a second axis of the housing. The first rotor and the second rotor engage with one another such that rotation of the first rotor and the second rotor pressurizes a vapor within the housing. The compressor includes an end plate coupled to a discharge end of the housing, where the end plate includes a variable opening configured to discharge a flow of the vapor from the housing. The end plate also includes a first movable member and a second movable member that are
(Continued)

configured to increase or decrease a cross-sectional area of the variable opening to adjust the flow of the vapor.

16 Claims, 8 Drawing Sheets

(51) Int. Cl.
*F04C 28/08* (2006.01)
*F04C 29/12* (2006.01)

(52) U.S. Cl.
CPC .... *F04C 2210/228* (2013.01); *F04C 2240/30* (2013.01); *F04C 2250/102* (2013.01); *F04C 2270/185* (2013.01)

(56) References Cited

U.S. PATENT DOCUMENTS

| | | | | |
|---|---|---|---|---|
| 2015/0093273 | A1* | 4/2015 | Johnson | F04C 28/24 418/1 |
| 2015/0135880 | A1* | 5/2015 | Zaruba | B25J 9/042 74/490.01 |

FOREIGN PATENT DOCUMENTS

| | | | |
|---|---|---|---|
| CN | 104421149 | A | 3/2015 |
| CN | 104454464 | A | 3/2015 |
| WO | 2015094466 | A1 | 6/2015 |

* cited by examiner

VARIABLE COMPRESSOR HOUSING

CROSS-REFERENCE TO RELATED APPLICATIONS

This application is a U.S. National Stage Application of PCT International Application No. PCT/US2018/059456, entitled " VARIABLE COMPRESSOR HOUSING," filed Nov. 6, 2018, which claims priority from and the benefit of U.S. Provisional Application Ser. No. 62/583,372, entitled "VARIABLE COMPRESSOR HOUSING," filed Nov. 8, 2017, each of which is hereby incorporated by reference in its entirety for all purposes.

BACKGROUND

The present disclosure relates generally to compressors, and more particularly, to screw compressors for heating, ventilating, air conditioning, and refrigeration (HVAC&R) systems.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Heating, ventilating, air conditioning, and refrigeration (HVAC&R) systems typically maintain temperature control in a structure by circulating a refrigerant through a conduit to exchange thermal energy with another fluid. A compressor of the system receives a cool, low pressure vapor and by virtue of compression, exhausts a hot, high pressure vapor. One type of compressor is a screw compressor, which generally includes one or more cylindrical rotors mounted on separate shafts inside a hollow casing. Twin screw compressor rotors typically have helically extending lobes (or flutes) and grooves (or flanks) on an outer surface to form threads on the circumference of the rotor.

During operation, the threads of the rotors mesh together, with the lobes on one rotor meshing with corresponding grooves on the other rotor to form a series of gaps between the rotors. The gaps form a continuous compression chamber that communicates with a compressor inlet opening at one end of the casing and continuously reduces in volume as the rotors turn to compress a gas (e.g., the refrigerant) and direct the gas toward a discharge port (e.g., a compressor outlet) at the opposite end of the casing. The size of the discharge port at least partially determines a magnitude by which the pressure of the gas is increased. For example, a small discharge port may increase a pressure differential (e.g., the compression ratio) between the compressor inlet and the compressor outlet, and a large discharge port may reduce the pressure differential between the compressor inlet and the compressor outlet. The size of the discharge port in existing screw compressors is generally fixed, and thus, adjusting the compression ratio of existing screw compressors is complex and may include relatively expensive components.

SUMMARY

The present disclosure relates to a compressor having a first rotor and a second rotor disposed within a housing, where the first rotor is configured to rotate about a first axis of the housing and the second rotor is configured to rotate about a second axis of the housing. The first rotor and the second rotor engage with one another such that rotation of the first rotor and the second rotor pressurizes a vapor within the housing. The compressor includes an end plate coupled to a discharge end of the housing, where the end plate includes a variable opening configured to discharge a flow of the vapor from the housing. The end plate also includes a first movable member and a second movable member that are configured to increase or decrease a cross-sectional area of the variable opening to adjust the flow of the vapor.

The present disclosure also relates to a vapor compression system having a compressor including a first rotor configured to rotate about a first axis and a second rotor configured to rotate about a second axis, where the first rotor and the second rotor are configured to engage with one another to compress a refrigerant within a housing of the compressor. The compressor includes an end plate coupled to the housing, where the end plate includes a variable opening configured to discharge a flow of the refrigerant from the housing to circulate the refrigerant through the vapor compression system. The end plate also includes a first movable member and a second movable member, where the first movable member and the second movable member are configured to adjust a cross-sectional area of the variable opening.

The present disclosure also relates to a method including rotating a first rotor of a compressor about a first axis and rotating a second rotor of the compressor about a second axis to pressurize a refrigerant within a housing of the compressor. The method also includes measuring an operating parameter of the compressor using a sensor and adjusting a cross-sectional area of a variable opening disposed within an end plate of the housing based on the operating parameter.

BRIEF DESCRIPTION OF THE DRAWINGS

Various aspects of this disclosure may be better understood upon reading the following detailed description and upon reference to the drawings in which.

DETAILED DESCRIPTION

Figure 1:
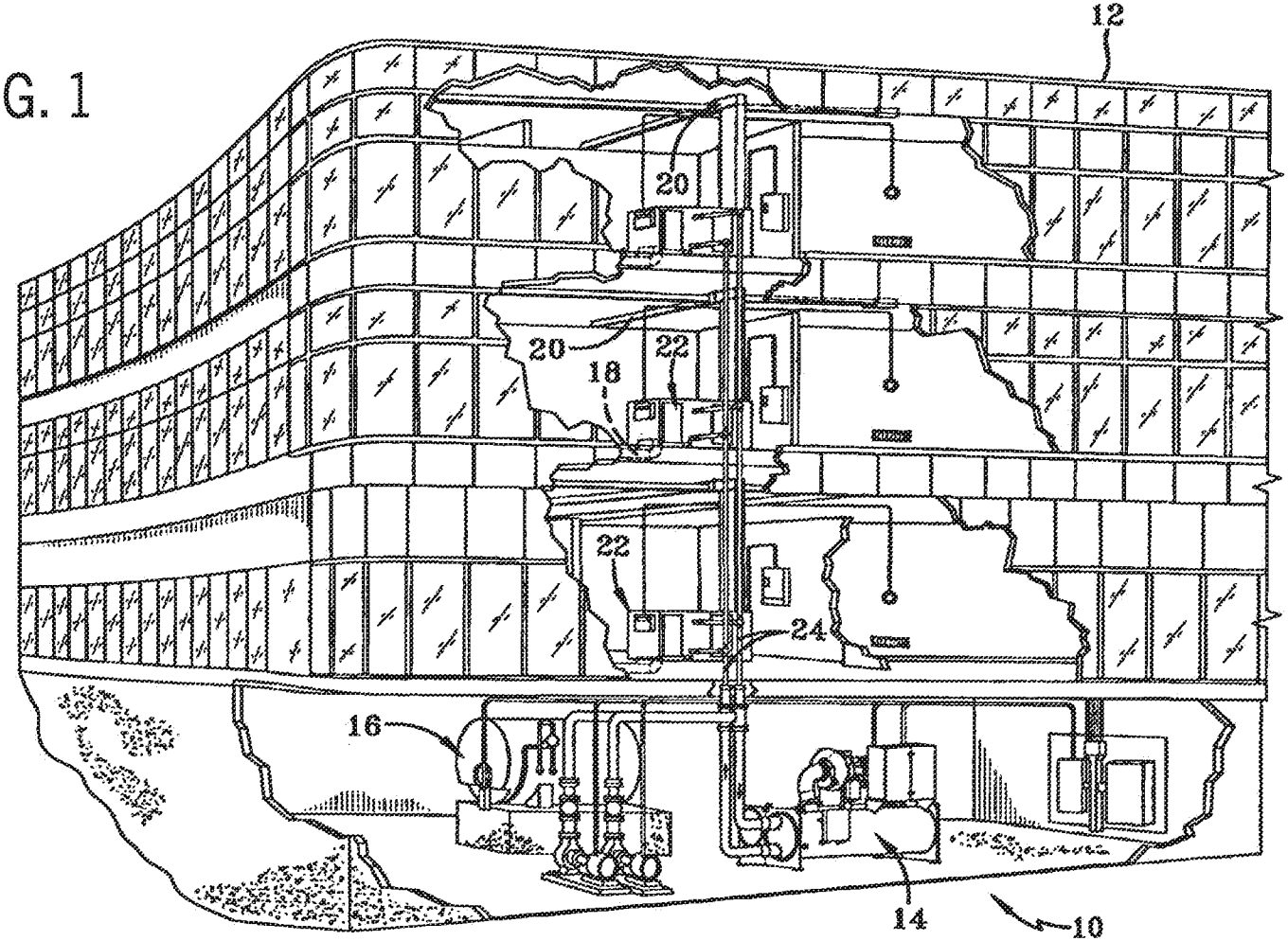
FIG. 1 is a perspective view of an embodiment of a building that may utilize a heating, ventilating, air conditioning, and refrigeration (HVAC&R) system in a commercial setting, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

A vapor compression system may include a screw compressor having one or more cylindrical rotors mounted on separate shafts disposed inside a hollow casing. The rotors of the compressor typically have helically extending lobes and grooves on an outer surface that form threads on the circumference of the rotors. Gaps between the lobes and the grooves of the rotors form a continuous compression chamber that is in fluid communication with a compressor inlet opening at one end of the casing. The gaps between the lobes and grooves may continuously decrease in volume from the compressor inlet toward a discharge port (e.g., a compressor outlet), at an opposite end of the compressor casing. As such, gas within the casing of the compressor is compressed and directed toward the discharge port as a result of rotation of the rotors. The size of the discharge port may at least partially determine the magnitude of a pressure increase between the compressor inlet and the compressor outlet. Typical compressors cannot adjust the size of the discharge port, and thus, alter the compression ratio of refrigerant flowing through the compressor using additional openings positioned in the casing near the discharge port. For example, movable pistons may be disposed within the additional openings and configured to regulate a flow of refrigerant through the additional openings, while the size of the discharge port remains constant. Unfortunately, the additional openings do not conform to a shape of the lobes and grooves of the rotors, which may enable refrigerant to be prematurely discharged from the compressor, and thus, decrease the efficiency of the compressor.

Embodiments of the present disclosure are directed to an end plate having an adjustable discharge port that may be coupled to the casing of the compressor. For example, a variable opening may be disposed within the end plate and configured to adjust the size (e.g., a cross sectional area) of the discharge port, and thus the compression ratio of the compressor. The variable opening may keep a desired profile (e.g., a geometric shape) of the discharge port substantially constant when adjusting the size of the discharge port. The profile of the discharge port may correlate to a size and/or a shape (e.g., a profile) of the rotors (e.g., lobes and grooves of a male rotor and/or a female rotor) of the compressor. Thus, matching the geometric shape of the discharge port to the profile of the rotors may enable the refrigerant to smoothly transition between the compression chamber and into the discharge port. Accordingly, an efficiency of the compressor may be enhanced.

In some embodiments, the end plate may include movable members configured to rotate about an axis and increase or decrease the size (e.g., the cross-sectional area) of the discharge port (e.g., the variable opening). When the movable members are rotated about the axis, the geometry of the discharge port (e.g., a general shape of the discharge port) may be maintained while the size of the discharge port is adjusted. As such, the variable opening may adjust the compression ratio of the compressor while the efficiency of the compressor may be substantially maintained. For example, the movable members may include contoured edges which correspond to the profile of the rotors (e.g., the lobes and grooves of the rotors). When the rotors of the compressor rotate about a respective axis, a trailing edge of the rotors may correspond with the contoured edges of the movable members. As such, the contoured edges may be configured to block refrigerant discharge from the compression chamber through openings other than discharge port (e.g., the variable opening). For example, the contoured edges of the movable members may enable the refrigerant to travel along the entire length of the rotors, and thus the entire length of the compression chamber, before discharging from the compression chamber through the discharge port.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
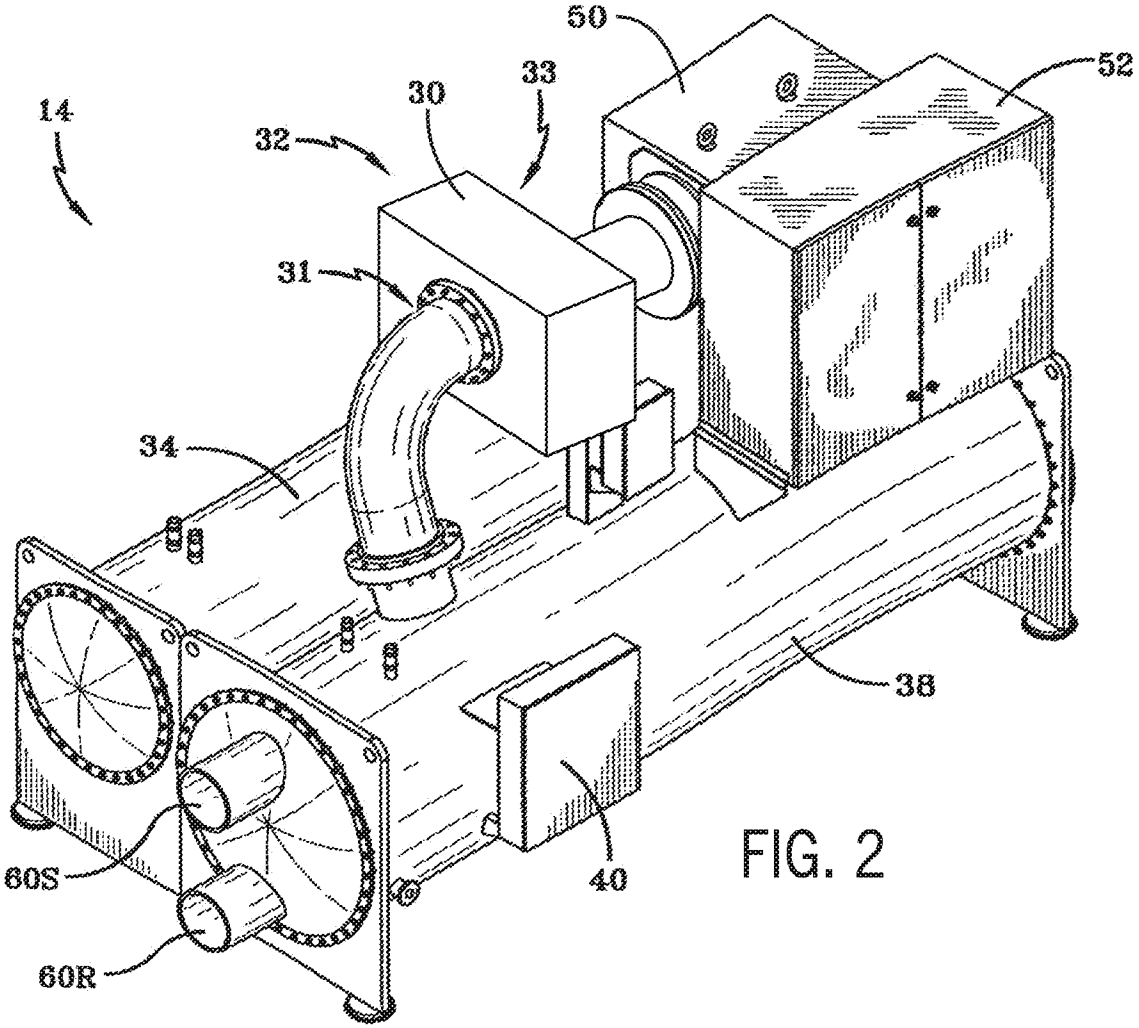
FIG. 2 is a perspective view of a vapor compression system including a compressor, in accordance with an aspect of the present disclosure.
Figure 3:
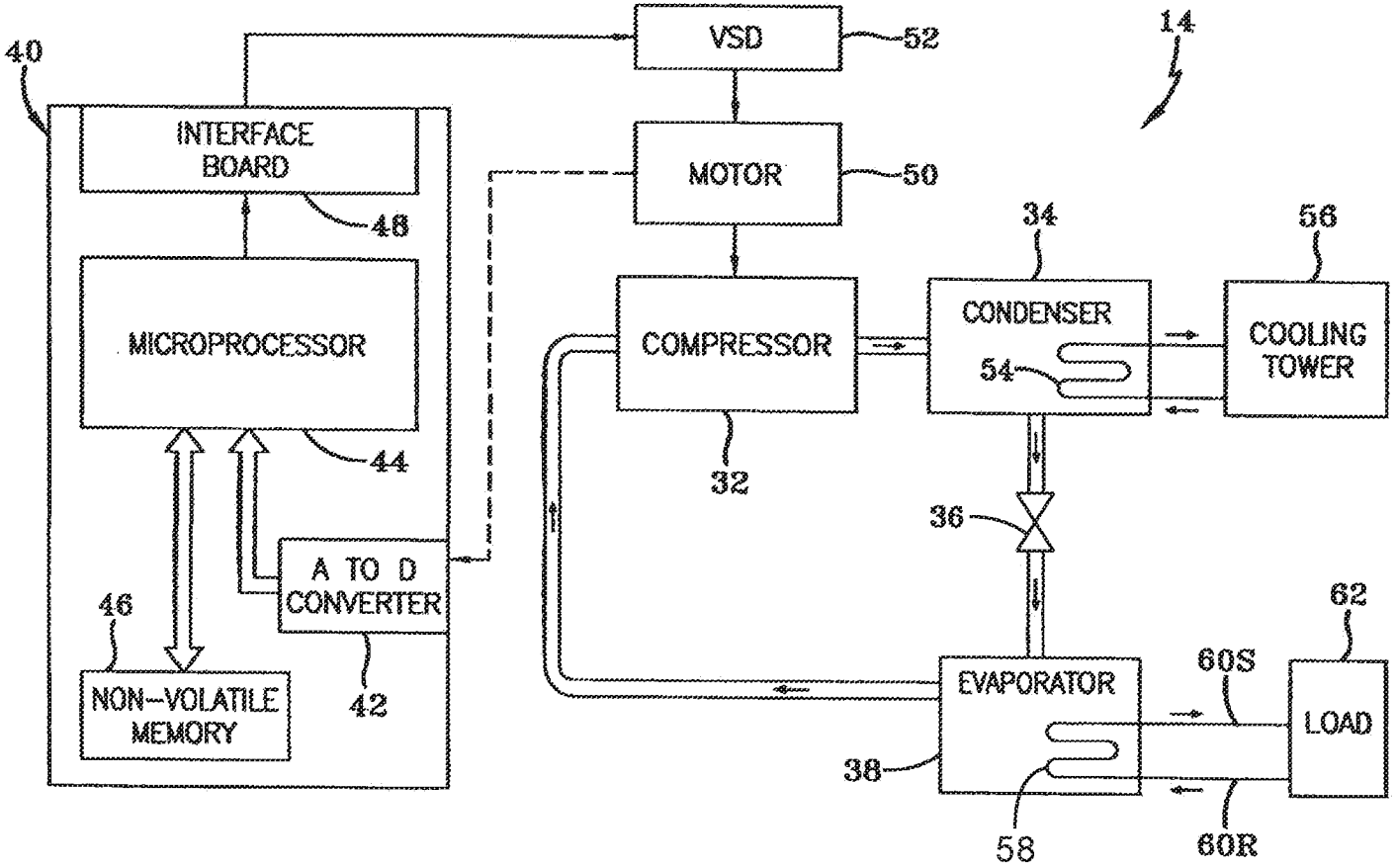
FIG. 3 is a schematic of an embodiment of the vapor compression system of FIG. 2, in accordance with an aspect of the present disclosure.

FIGS. 2 and 3 are embodiments of the vapor compression system 14 that can be used in the HVAC&R system 10. The vapor compression system 14 may circulate a refrigerant through a circuit starting with a compressor 32. In some embodiments, the compressor 32 may include a screw compressor. The compressor 32 may include a pressurized housing 30 which houses rotors (e.g., a male rotor, a female rotor) of the compressor 32. The housing 30 may include a compressor inlet 31 (e.g., an upstream portion of the housing 30) through which the compressor 32 receives the refrigerant and a compressor outlet 33 (e.g., a downstream portion of the housing 30) through which the compressor 32 discharges the refrigerant. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia ($NH_3$), R-717, carbon dioxide ($CO_2$), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of electric motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
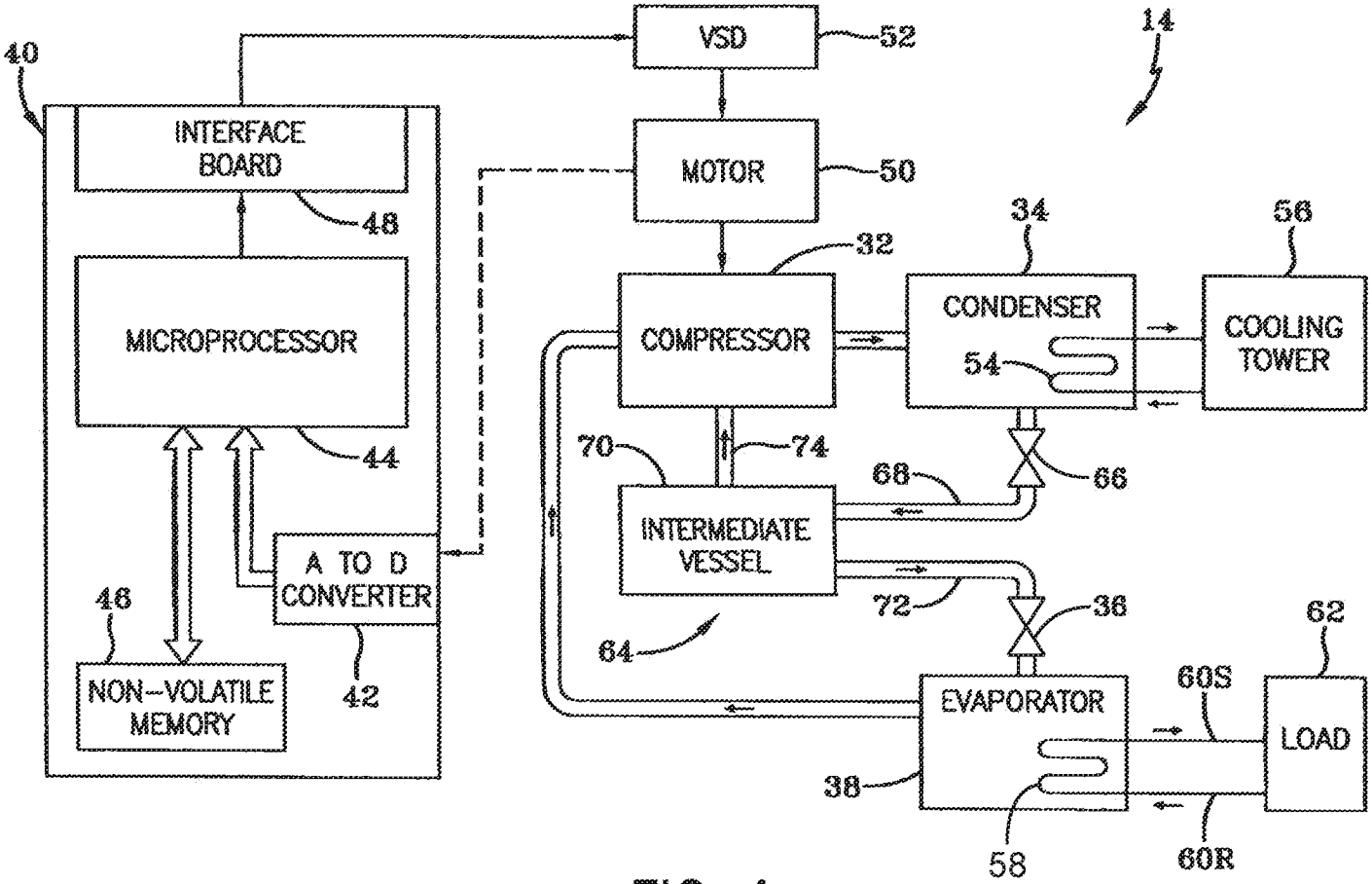
FIG. 4 is a schematic of an embodiment of the vapor compression system of FIG. 2, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66. Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

Figure 5:
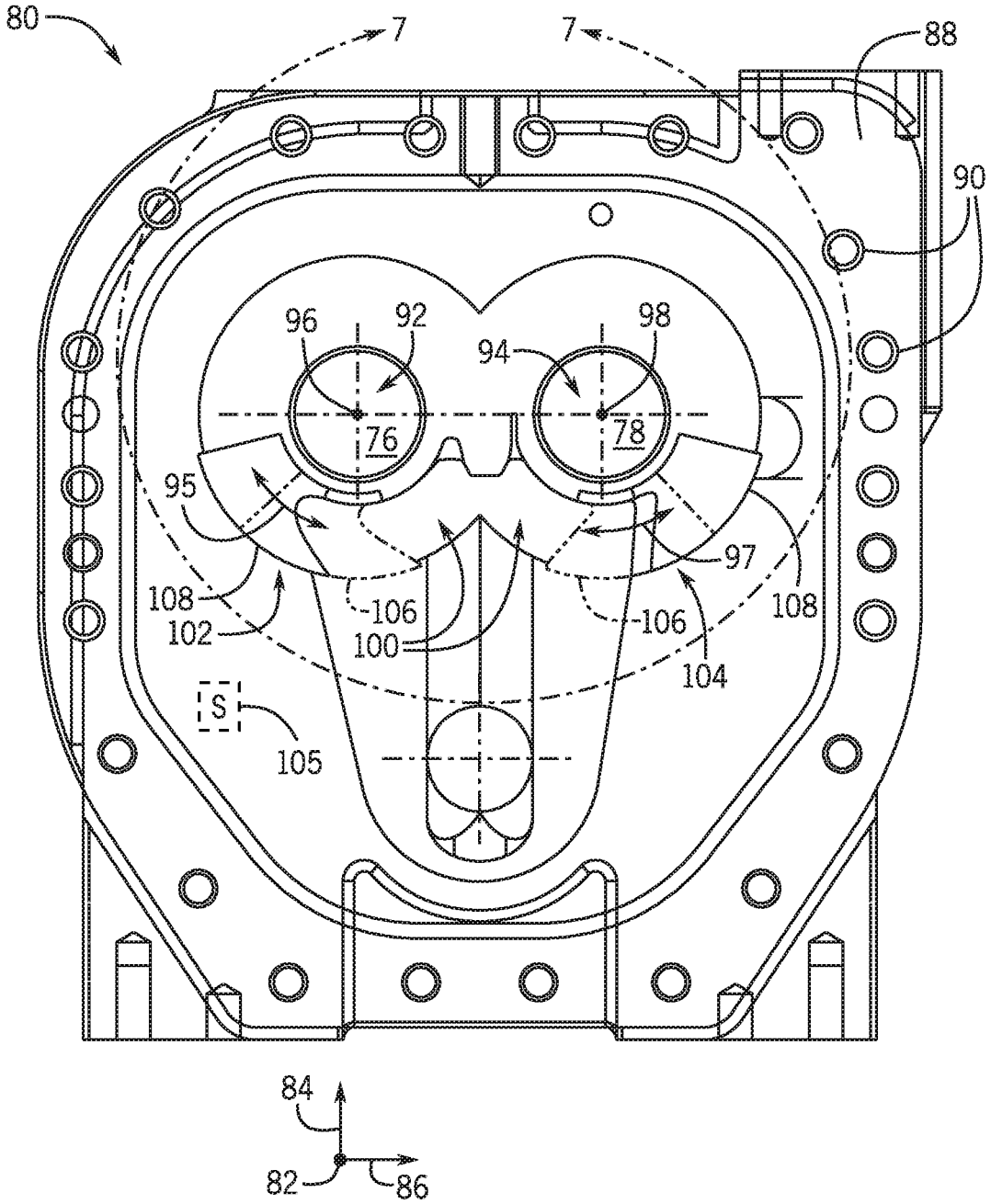
FIG. 5 is a cross-sectional view of an embodiment of an end plate that may couple to a housing of the compressor of FIG. 2, in accordance with an aspect of the present disclosure.

As discussed above, the compressor 32 may include a screw compressor that includes a first rotor 76 (as shown in FIG. 5) and a second rotor 78 (as shown in FIG. 5). However, it should be noted that in other embodiments, the compressor 32 may include a single rotor or more than two rotors. That is, the compressor 32 may include 1, 2, 3, 4, or more than 4 rotors. Accordingly, it should be appreciated that the embodiments of the compressor end plate discussed herein may be implemented on compressors having any suitable quantity of rotors. In any case, the first rotor 76 (e.g., a male rotor) may include one or more protruding lobes that extend axially along a length of the first rotor 76. The second rotor 78 (e.g., a female rotor) may include one or more concave grooves that extend axially along a length of the second rotor 78. During operation, the lobes on the first rotor 76 may mesh with the corresponding grooves on the second rotor 78 to form a series of gaps between the rotors 76, 78. The gaps may form a continuous compression chamber that is in fluid communication with the compressor inlet 31 and the compressor outlet 33. During operation of the compressor 32, the gaps may continuously reduce in volume and thus compress the refrigerant along a length of the rotors 76, 78 from the compressor inlet 31 toward the compressor outlet 33.

It should be noted that embodiments of the rotors 76, 78 disclosed herein may apply to screw compressors having rotors that are disposed side-by-side, in addition to, or in lieu of, rotors that are disposed above-and-below one another. While the present discussion focuses on an end plate for compressors that are utilized in HVAC&R systems, it should be understood by those of ordinary skill in the art that the embodiments of the end plate disclosed herein may be used in any suitable compressor or system that utilizes a compressor. For example, the end plate may be included in air compressors that supply pressurized air to pneumatic devices, such as tools, compressors included in a supercharger for a car engine, and/or compressors utilized in airplanes, boats, and/or other suitable applications.

With the foregoing in mind, FIG. 5 is a cross-sectional schematic view of an end plate 80 that may couple to the housing 30 of the compressor 32. For example, the end plate 80 may couple to the compressor inlet 31, the compressor outlet 33, or both. To facilitate discussion, the end plate 80 and its components may be described with reference to a longitudinal axis or direction 82, a vertical axis or direction 84, and a lateral axis or direction 86. In some embodiments, the end plate 80 may couple to the compressor outlet 33 via one or more fasteners (e.g., bolts, spring pins, or other suitable fasteners). A gasket may be disposed between the compressor outlet 33 and a flange 88 of the end plate 80 to seal the housing 30. The fasteners may extend through one or more mounting holes 90 within the end plate 80 and may be configured to apply a compressive force between the end plate 80 and the compressor outlet 33. The gasket may be compressed axially (e.g., in the longitudinal 82 direction) and form a seal between the end plate 80 and the compressor outlet 33 of the housing 30. In some embodiments, the gasket blocks refrigerant from inadvertently discharging into the ambient environment (e.g., the atmosphere) between mating surfaces of the housing 30 and the end plate 80.

The end plate 80 may include a first opening 92 and a second opening 94 extending axially (e.g., in the longitudinal 82 direction) through the end plate 80. The first opening 92 and the second opening 94 may be defined by a first axial centerline 96 and a second axial centerline 98, respectively. The first axial centerline 96 and the second axial centerline 98 may extend parallel to the longitudinal 82 direction. The rotors 76, 78 may include axially protruding shafts configured to rotatably couple to the openings 92, 94 disposed within the end plate 80. For example, the first opening 92 may receive a first shaft of the first rotor 76 (e.g., the male rotor) and the second opening 94 may receive a second shaft of the second rotor 78 (e.g., the female rotor). In some embodiments, bearings (e.g., ball bearings, needle bearings) may be disposed within the openings 92, 94 to reduce friction between the openings 92, 94 and the shafts as the shafts rotate. In other embodiments, a lubricant (e.g., oil) may be used to reduce the friction between the openings 92, 94, and the shafts of the rotors 76, 78. For example, in lieu of using the bearings, the lubricant may be disposed between and interior surface of the openings 92, 94 and an exterior surface of the shafts. Thus, the shafts may rotate on a thin film of lubricant between the interior surface of the openings 92, 94 and the exterior surface of the shafts.

The shafts may extend through the openings 92, 94 such that an axial centerline of the first rotor 76 and an axial centerline of the second rotor 78 are coaxial with the first axial centerline 96 and the second axial centerline 98, respectively. Thus, the first rotor 76 may rotate about the first axial centerline 96 and the second rotor 78 may rotate about second axial centerline 98, while being restricted from movement in the longitudinal 82, vertical 84, and/or lateral 86 direction by the openings 92, 94. Although two openings 92, 94 are shown in the illustrated embodiment of FIG. 5, the end plate 80 may include 3, 4, 5, 6 or more openings that are configured to receive a third rotor, a fourth rotor, a fifth rotor, a sixth rotor, and so on.

As discussed previously, the rotors 76, 78 of the compressor 32 may direct refrigerant from the compressor inlet 31 into the housing 30, compress the refrigerant along the lengths of the rotors 76, 78, and discharge the refrigerant through the compressor outlet 33. As described in greater detail herein, the end plate 80 may include a variable opening 100 (e.g., an axial port) through which the compressor 32 may discharge the refrigerant. In some embodiments, the end plate 80 may include a first movable member 102 and a second movable member 104 that may be configured to adjust the size (e.g., a cross-sectional area) of the variable opening 100. The first movable member 102 may be configured to at least partially rotate about the first axial centerline 96 (e.g., as shown by arrow 95) and the second movable member 104 may be configured to at least partially rotate about the second axial centerline 98 (e.g., as shown by arrow 97). Thus, the first movable member 102 and the second movable member 104 may be configured to vary the cross-sectional area of the variable opening 100. As such, the variable opening 100 may be configured to adjust an operating parameter (e.g., a volumetric flow rate, a pressure) of the flow of the refrigerant discharged from the compressor 32. As described in greater detail herein, a sensor 105 disposed within the housing 30 may measure an operating parameter of the compressor, such that the size of the variable opening 100 may be adjusted based on the operating parameter. Additionally or alternatively, the sensor 105 may be disposed in any other suitable portion of the vapor compression system 14.

Figure 6:
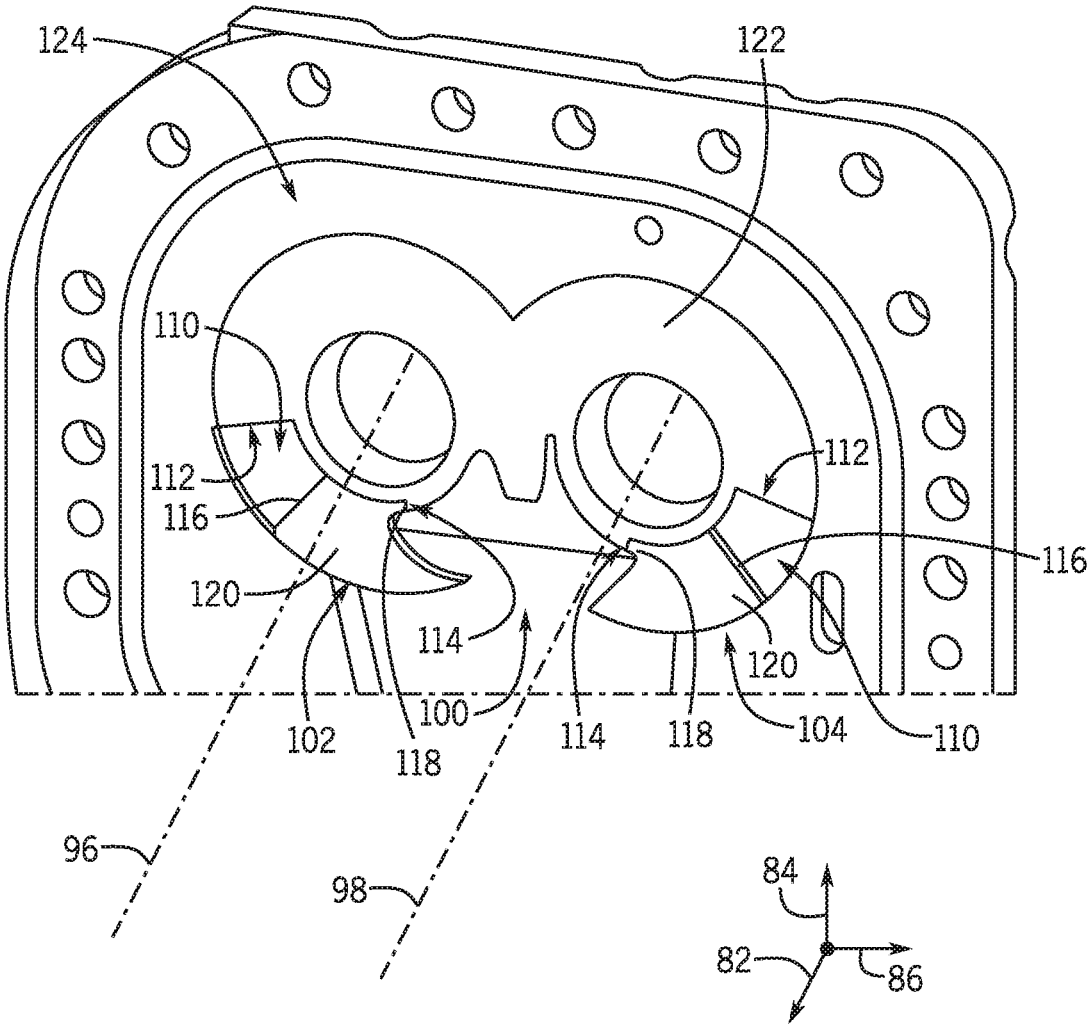
FIG. 6 is a perspective view of an embodiment of the end plate of FIG. 5, in accordance with an aspect of the present disclosure.
Figure 8:
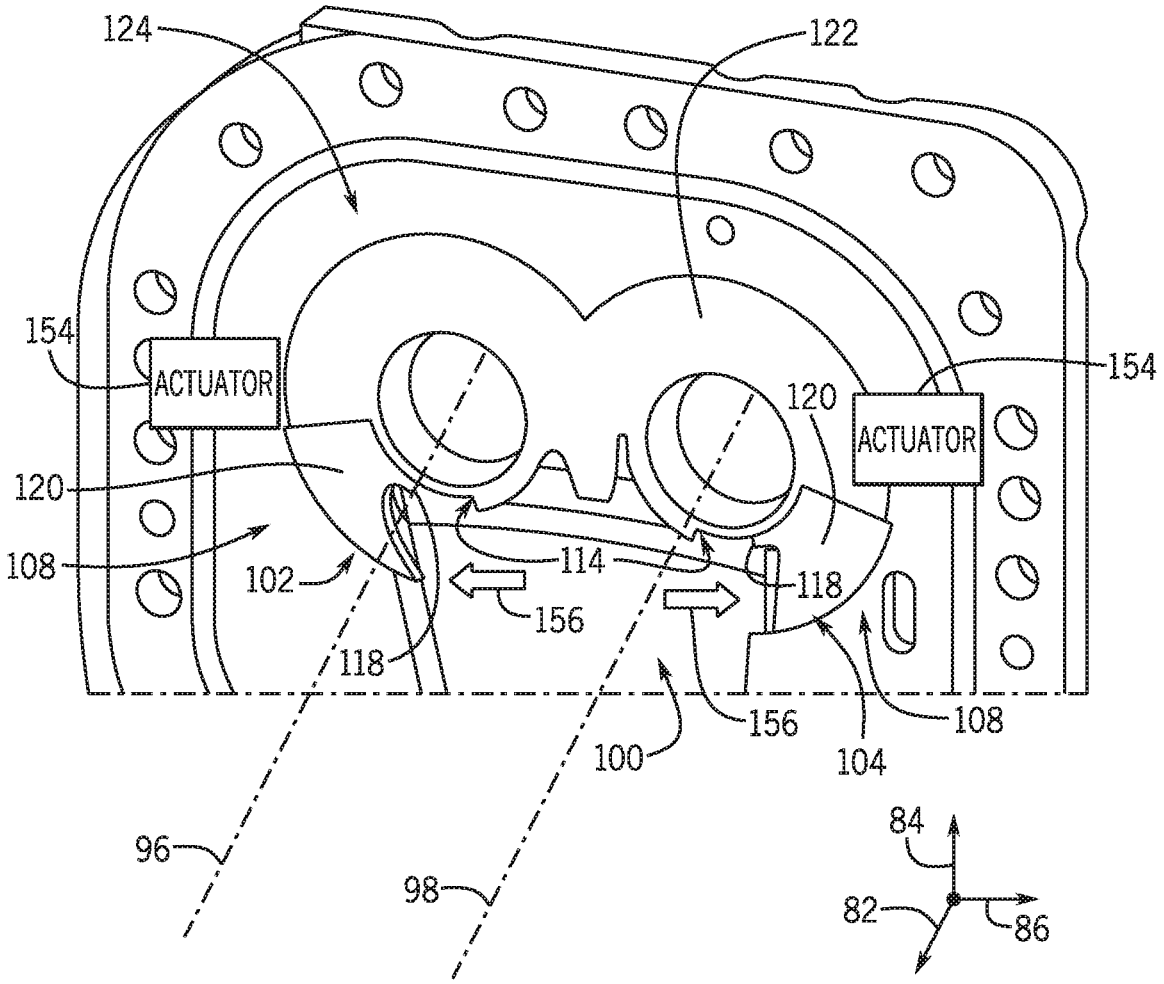
FIG. 8 is a perspective view of an embodiment of the end plate of FIG. 5, in accordance with an aspect of the present disclosure.

In some embodiments, the movable members 102, 104 may move (e.g., rotate) from a first position 106 (as shown in FIG. 6) to a second position 108 (as shown in FIG. 8) by rotating about the first axial centerline 96 and the second axial centerline 98, respectively. As discussed in greater detail herein, the compressor 32 may discharge a lower flow rate of refrigerant when the movable members 102, 104 are in the first position 106 (e.g., the variable opening 100 is relatively small) and discharge an increased flow rate of refrigerant when the movable members 102, 104 are in the second position 108 (e.g., the variable opening 100 is relatively large). In some embodiments, the compressor 32 may pressurize the refrigerant to a relatively high pressure when the movable members 102, 104 are in the first position 106 (e.g., the variable opening 100 is relatively small). The compressor 32 may pressurize the refrigerant to a relatively low pressure when the movable members 102, 104 are in the second position 108 (e.g., the variable opening 100 is relatively large). Additionally or alternatively, the first movable member 102 and the second movable member 104 may be positioned in any position between the first position 102 and the second position 104 to adjust a discharge pressure of the refrigerant to a predetermined pressure (e.g., a target discharge pressure).

FIG. 6 is a perspective view of an embodiment of the end plate 80. In some embodiments, the movable members 102, 104 may rotate within respective grooves 110 (e.g., a first groove, a second groove) of the end plate 80. The grooves 110 may each include a first stop 112 (e.g., a rear stop) and a second stop 114 (e.g., a front stop) that may be configured to limit movement of the movable members 102, 104 within the grooves 110. Additionally, the first stops 112 and the second stops 114 may define the minimum cross-sectional area (FIG. 6) and the maximum cross-sectional area (as shown in FIG. 8) of the variable opening 100. For example, the first stops 112 may be configured to engage with surfaces 116 (e.g., rear surfaces) of the movable members 102, 104, and block the movable members 102, 104 from rotating about the centerlines 96, 98 and further expanding the cross-sectional area of the variable opening 100. The first movable member 102 may rotate clockwise about the first axial centerline 96 until the surface 116 of the first movable member 102 contacts the respective first stop 112. The second movable member 104 may rotate counter-clock wise about the second axial centerline 98 until the surface 116 of the second movable member 104 contacts the respective first stop 112. As such, the first stops 112 may define a maximum cross-sectional area of the variable opening 100 which the movable members 102, 104 may generate.

The second stops 114 may be configured to engage with respective tabs 118 of the movable members 102, 104, and block the movable members 102, 104 from rotating about the centerlines 96, 98 and further reducing the cross-sectional area of variable opening 100. For example, the first movable member 102 may rotate counter-clockwise about the first axial centerline 96 until the tab 118 of the first movable member 102 contacts the respective second stop 114 of the end plate 80. The second movable member 104 may rotate clockwise about the second axial centerline 98 until the tab 118 of the second movable member 104 contacts the respective second stop 114 of the end plate 80. As such, the second stops 114 may define a minimum cross-sectional area of the variable opening 100, in which the movable members 102, 104 may generate.

In some embodiments, a depth (e.g., a longitudinal 82 distance) of the grooves 110 may be substantially equal to a thickness (e.g., a longitudinal 82 distance) of the movable members 102, 104. As such, a top surface 120 of the movable members 102, 104 and an inner surface 122 of the end plate 80 may be coplanar within a plane defined by the vertical 84 axis and the lateral 86 axis. As described in greater detail herein, the top surface 120 of the movable members 102, 104 and the inner surface 122 of the end plate 80 may thus direct the pressurized refrigerant between the gaps of the rotors 76, 78 to the variable opening 100, and block pressurized refrigerant from leaking into a space 124 disposed between the housing 30 of the compressor 32 and the end plate 80.

Figure 7:
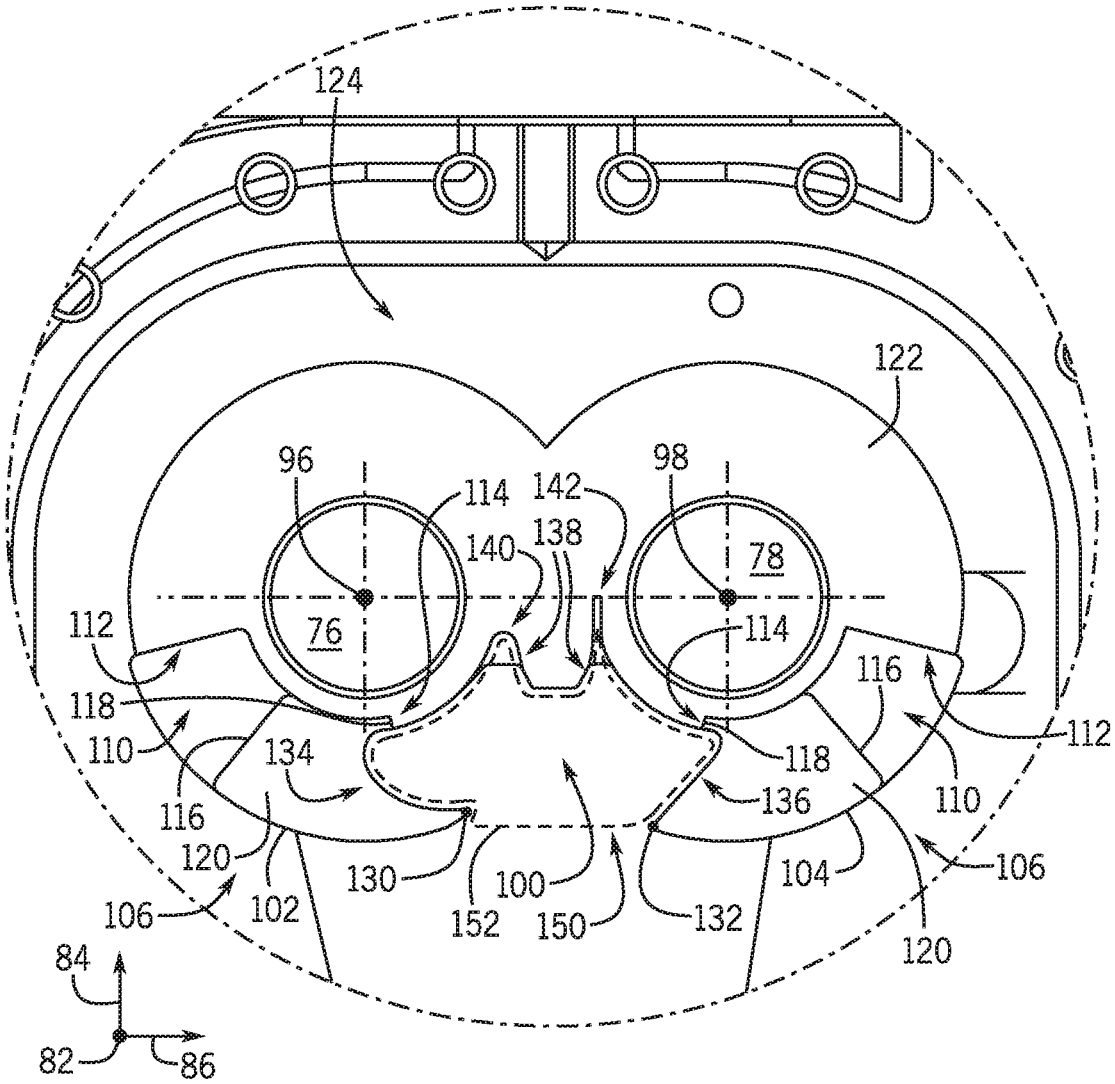
FIG. 7 is an expanded view of line 7-7 of FIG. 5, illustrating a variable discharge port in the end plate, in accordance with an aspect of the present disclosure.

FIG. 7 is an expanded view of the end plate 80 taken along line 7-7 shown in FIG. 5. FIG. 7 illustrates the movable members 102, 104 in the first position 106 (e.g., a high pressure position) in which the cross-sectional area of the variable opening 100 is relatively small. As shown in the illustrated embodiment of FIG. 7, the first movable member 102 includes a first tip 130 and the second movable member 104 includes a second tip 132, such that the movable members 102, 104 may include a contoured profile that extends between the respective tabs 118 and the tips 130, 132 of the movable members 102, 104. For example, a profile 134 extending between the tab 118 of the first movable member 102 and the first tip 130 may be curved (e.g., generally parabolic). A profile 136 extending between the tab 118 of the second movable member 104 and the second tip 132 may be substantially linear (e.g., generally a straight line). In some embodiments, the profile 134 of the first movable member 102 and the profile 136 of the second movable member 104 may be substantially the same. Additionally or alternatively, the profiles 134, 136 may be defined by a path of any other shape, such as jagged, cubic, or logarithmic.

In any case, the profiles 134, 136 may be configured to conform to or correspond with a profile (e.g., a contoured edge) of the first rotor 76 and a profile of the second rotor 78, respectively. For example, as the first rotor 76 (e.g., the male rotor) of the compressor 32 rotates about the first axial centerline 96, a trailing edge of the helical lobes disposed on the first rotor 76 may generally form a shape that conforms to the profile 134 (e.g., the parabolic curve) of the first movable member 102. Similarly, when the second rotor 78 (e.g., the female rotor) of the compressor rotates about the second axial centerline 98, a trailing edge of the helical grooves disposed within the second rotor 78 may generally form a shape that conforms to the profile 136 (e.g., the linear line) of the second movable member 104. Matching the profiles 134, 136 of the first movable member 102 and the second movable member 104, respectively, with the profiles of the first rotor 76 and the second rotor 78, respectively, may enable the refrigerant to remain compressed between the lobes of the first rotor 76 and the grooves of the second rotor 78 (e.g., in the compression chamber) for as long a distance as possible before discharging into the variable opening 100. For example, the profiles 134, 136 may block refrigerant from being discharged from the compression chamber before reaching the discharge port (e.g., the variable opening 100). As such, the refrigerant may travel along the entire length of the rotors 76, 78, and thus, the entire length of the compression chamber, which may increase the efficiency of the compressor 32.

In some embodiments, the interior surface 122 of the end plate 80 may include a profile 138 between the second stop 114 of the first movable member 102 and the second stop 114 of the second movable member 104, which may additionally conform to the profile of the first and second rotors 76, 78. For example, a first section 140 of the profile 138 may be configured to conform to the profile (e.g., the trailing edge) of the first rotor 76 (e.g., the male rotor) and a second section 142 of the profile 138 may be configured to conform to the profile (e.g., the trailing edge) of the second rotor 78 (e.g., the female rotor).

As discussed above, the inner surface 122 of the end plate 80 and the top surface 120 of the movable members 102, 104 may block the refrigerant from discharging into the space 124 within the end plate 80, and thus direct substantially all of the refrigerant towards the variable opening 100. The variable opening 100 includes a perimeter 150 that defines the area of the variable opening 100 through which refrigerant may discharge from the casing 30. For example, the perimeter 150 of the variable opening 100 is defined by at least the profile 134 of the first movable member 102, the profile 138 of the inner surface 122, the profile 136 of the second movable member 104, and a line 152 extending between the tip 132 of the second movable member 104 and the tip 130 of the first movable member 102. In some embodiments, the movable members 102, 104 may adjust an area formed by the perimeter 150 of the variable opening 100 (e.g., the cross-sectional area of the variable opening 100), and may thus adjust operating parameters (e.g., volumetric flow rate, pressure) of the compressor 32.

FIG. 8 is a perspective view of the end plate 80 showing the movable members 102, 104 in the second position 108 (e.g., a low pressure position). The movable members 102, 104 may move between the first position 106 and the second position 108 manually (e.g., via an operator) or via one or more actuators 154 (e.g., a hydraulic actuator, an electric actuator, a pneumatic actuator, or another suitable actuator). For example, in some embodiments, the operator may manually rotate the first movable member 102 and the second movable member 104 about the first axial centerline 96 and the second axial centerline 98, respectively. In other embodiments, the actuators 154 may be used to rotate the movable members 102, 104, about the first axial centerline 96 and the second axial centerline 98, respectively.

In embodiments that include the actuators 154, the actuators 154 may be configured to move the movable members 102, 104 together or separately. For example, in some embodiments, a single actuator may be configured to move both the first movable member 102 and the second movable member 104. In other embodiments, the first movable member 102 may be moved by a first actuator and the second movable member 104 may be moved by a second actuator.

In some cases, the pressurized refrigerant discharged from the compressor 32 may impose a force (e.g., represented as arrows 156) upon the movable members 102, 104. In some embodiments, the force 156 may be a compressive force applied to the first movable member 102 in a clockwise direction about the first axial centerline 96 and applied to the second movable member 104 in a counter-clockwise direction about the second axial centerline 98. The movable members 102, 104 may be held stationary via a counterforce (e.g., a force opposite in direction and magnitude to the force 156) provided by the actuators 154 and/or fasteners (e.g., bolts, adhesives). For example, when the operator adjusts the movable members 102, 104 to a desired position, the operator may then couple the movable members 102, 104 to the end plate 80 via the fasteners, such that positions of the movable members 102, 104 are substantially fixed. In other embodiments, the actuators 154 (e.g., a hydraulic actuator, an electric actuator, a pneumatic actuator, or another suitable actuator) may provide the counter force. Additionally or alternatively, positions of the movable members 102, 104 may be secured using a combination of both the fasteners and the actuators 154.

Figure 9:
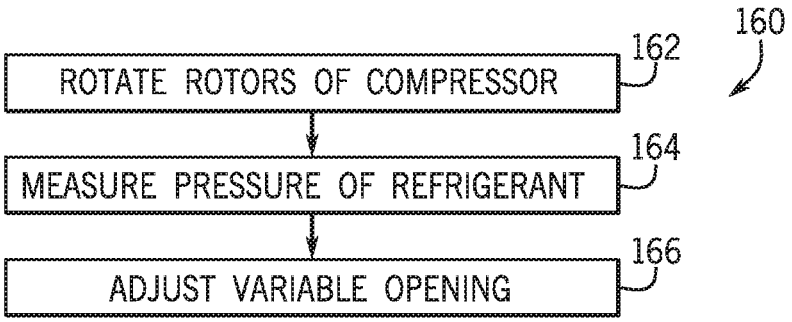
FIG. 9 is a flow chart of an embodiment of a method for operating the compressor having the end plate of FIG. 5, in accordance with an aspect of the present disclosure.

FIG. 9 is an embodiment of a method 160 that may be used to operate the compressor 32 having the end plate 80. For example, at block 162, the rotors 76, 78 of the compressor are rotated to enable the lobes of the first rotor 76 (e.g., the male rotor) to mesh with the grooves of the second rotor 78 (e.g., the female rotor), which ultimately forms the compression chamber (e.g., the series of gaps) between the rotors. The continuous compression chamber may be in fluid communication with the compressor inlet 31 at one end of the housing 30 and the compressor outlet 33 at the other end of the housing 30. The compression chamber may continuously reduce in volume, thus compressing the refrigerant toward the compressor outlet 32 (e.g., through the variable opening 100 of the end plate 80). Thus, the compressor 32 may pressurize the refrigerant within the vapor compression system 14 and/or circulate the refrigerant throughout the conduits of the vapor compression system 14.

At block 164, a parameter of the refrigerant within the housing 30 of the compressor 32 may be measured. For example, the sensor 105 (e.g., a pressure gauge, pressure transducer) may measure an operating parameter (e.g., the discharge pressure, a static pressure) of the refrigerant exiting the compressor 32. Additionally or alternatively, the sensor 105 may be positioned along another suitable portion of the vapor compression system 14. In any case, at block 166, the measured operating parameter may be used to determine whether an adjustment of the variable opening 100 is desirable. The variable opening 100 may be adjusted based at least partially on the measured operating parameter. For example, if the discharge pressure of refrigerant exiting the compressor 32 is below a desired threshold, an area of the variable opening 100 may be decreased (e.g., the movable members 102, 104 are moved towards the first position 106), thus increasing the pressure within the compression chamber of the compressor 32. If a discharge pressure of the refrigerant exiting the compressor 32 is above a desired threshold, an area of variable opening 100 may be increased (e.g., the movable members 102, 104 are moved towards the second position 108), thus increasing the pressure within the compression chamber of the compressor 32.

To approach the first position 106, the first movable member 102 may rotate counter-clockwise about the axial centerline 96 of the first opening 92 until the tab 118 of the first movable member 102 contacts the respective second stop 114 of the end plate 80. The second movable member 104 may rotate clockwise about the axial centerline 98 of the second opening 94 until the tab 118 of the second movable member 104 contacts the respective second stop 114 of the end plate 80. Thus, a distance between the first movable member 102 and the second movable member 104 may be reduced, which also reduces an area of the variable opening 100. To reach the second position 108, the first movable member 102 may rotate clockwise about the axial centerline 96 of the first opening 92 until the surface 116 of the first movable member 102 contacts the respective first stop 112 of the end plate 80. Similarly, the second movable member 104 may rotate counter-clock wise about the axial centerline 98 of the second opening 94 until the surface 116 of the second movable member 104 contacts the respective first stop 112 of the end plate 80. Thus, a distance between the first movable member 102 and the second movable member 104 may be increased, which also increases an area of the variable opening 100.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode, or those unrelated to enablement). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A compressor for a vapor compression system, comprising:

a housing;

a first rotor and a second rotor disposed within the housing, wherein the first rotor is configured to rotate about a first axis of the housing and the second rotor is configured to rotate about a second axis of the housing, wherein the first rotor and the second rotor are configured to engage with one another such that rotation of the first rotor and the second rotor pressurizes a vapor within the housing; and an end plate coupled to a discharge end of the housing, wherein the end plate comprises:

an inner surface;

an opening extending through the inner surface and configured to receive a shaft of the first rotor;

a variable opening extending through the inner surface and configured to discharge a flow of the vapor from the housing;

a first groove recessed in the inner surface;

a second groove recessed in the inner surface; and a first movable member disposed within the first groove and a second movable member disposed within the second groove, wherein the first movable member is configured to slide along the first groove and the second movable member is configured to slide along the second groove to increase or decrease a cross-sectional area of the variable opening to adjust the flow of the vapor, the first groove and the second groove each define a respective first stop and a respective second stop, the first stop of the first groove and the second stop of the first groove are configured to limit movement of the first movable member within the first groove via contact with the first movable member, and the first stop of the second groove and the second stop of the second groove are configured to limit movement of the second movable member within the second groove via contact with the second movable member.

2. The compressor of claim 1, wherein the first movable member is configured to rotate about the first axis of the housing and the second movable member is configured to rotate about the second axis of the housing.

3. The compressor of claim 1, wherein the first movable member and the second movable member are configured to transition between respective first positions and respective second positions.

4. The compressor of claim 3, wherein the respective first positions are defined by the first movable member rotating counter-clockwise about the first axis until a first tab of the first movable member contacts the second stop of the first groove and the second movable member rotating clockwise about the second axis until a second tab of the second movable member contacts the second stop of the second groove.

5. The compressor of claim 4, wherein the respective second positions are defined by the first movable member rotating clockwise about the first axis until a first surface of the first movable member contacts the first stop of the first groove and the second movable member rotating counter-clockwise about the second axis until a second surface of the second movable member contacts the first stop of the second groove.

6. The compressor of claim 1, wherein the first movable member comprises a first profiled edge and the second movable member comprises a second profiled edge.

7. The compressor of claim 6, wherein the first profiled edge is configured to conform to a first trailing edge of the first rotor and the second profiled edge is configured to conform to a second trailing edge of the second rotor.

8. The compressor of claim 1, comprising a single actuator configured to rotate the first movable member about the first axis and rotate the second movable member about the second axis.

9. The compressor of claim 8, wherein the single actuator comprises a hydraulic actuator.

10. The compressor of claim 1, comprising a first actuator configured to rotate the first movable member about the first axis and a second actuator configured to rotate the second movable member about the second axis.

11. A vapor compression system, comprising:

a compressor including a first rotor configured to rotate about a first axis and a second rotor configured to rotate about a second axis, wherein the first rotor and the second rotor are configured to engage with one another to compress a refrigerant within a housing of the compressor; and an end plate coupled to the housing, wherein the end plate comprises:

an inner surface;

a first opening extending through the inner surface and configured to receive a first shaft of the first rotor;

a second opening extending through the inner surface and configured to receive a second shaft of the second rotor, wherein the inner surface circumferentially surrounds the first opening and the second opening independently of one another;

a variable opening extending through the inner surface and configured to discharge a flow of the refrigerant from the housing to circulate the refrigerant through the vapor compression system;

a first groove recessed in the inner surface;

a second groove recessed in the inner surface; and a first movable member disposed within the first groove and a second movable member disposed within the second groove, wherein the first movable member is configured to slide along the first groove, the first movable member extends only partially about a first circumference of the first opening, the second movable member is configured to slide along the second groove to adjust a cross-sectional area of the variable opening, and the second movable member extends only partially about a second circumference of the second opening.

12. The vapor compression system of claim 11, wherein the first movable member and the second movable member are configured to adjust the cross-sectional area of the variable opening to adjust a pressure of the refrigerant within the housing, a flow rate of the flow of the refrigerant discharged from the housing, a pressure of the flow of the refrigerant discharged from the housing, or a combination thereof.

13. The vapor compression system of claim 11, wherein the first movable member is configured to slide along the first groove and rotate about the first axis and the second movable member is configured to slide along the second groove and rotate about the second axis.

14. The vapor compression system of claim 13, comprising one or more actuators configured to rotate the first movable member about the first axis and rotate the second movable member about the second axis.

15. The vapor compression system of claim 11, wherein the first movable member comprises a first profiled edge configured to conform to a first trailing edge of the first rotor when the first rotor rotates about the first axis and the second movable member comprises a second profiled edge configured to conform to a second trailing edge of the second rotor when the second rotor rotates about the second axis.

16. The vapor compression system of claim 11, comprising a sensor disposed within the housing of the compressor, wherein a first position of the first movable member and a second position of the second movable member are adjusted based on feedback from the sensor indicative of a discharge pressure of the flow of the refrigerant.

* * * * *